US005353935A

United States Patent [19]

Yeager et al.

[11] Patent Number: 5,353,935

[45] Date of Patent: Oct. 11, 1994

[54] BLISTER PACKAGE WITH RECLOSABLE CARD

[75] Inventors: Robert W. Yeager; Andy Talbot, both of Goodlettsville, Tenn.

[73] Assignee: Anchor Wire Corporation, Goodlettsville, Tenn.

[21] Appl. No.: 188,919

[22] Filed: Jan. 31, 1994

[51] Int. Cl.[5] ..... B65D 73/00

[52] U.S. Cl. ..... 206/470; 206/813; 206/815; 206/516

[58] Field of Search ..... 206/470, 461, 813, 815

[56] References Cited

U.S. PATENT DOCUMENTS

| | | | |
|---|---|---|---|
| 3,088,587 | 5/1963 | Dimmig et al. | 206/470 |
| 3,174,621 | 3/1965 | Watson | 206/78 |
| 3,198,681 | 8/1965 | Watts, Jr. | 156/196 |
| 3,948,391 | 4/1976 | Beaman | 206/382 |
| 3,967,730 | 7/1976 | Driscoll et al. | 206/461 |
| 4,119,203 | 10/1978 | Kuchenbecker | 206/461 |
| 4,209,095 | 6/1980 | Dutcher | 206/469 |
| 4,236,636 | 12/1980 | Kuchenbecker | 206/461 |
| 4,512,474 | 4/1985 | Harding | 206/461 |
| 4,673,085 | 6/1987 | Badouard et al. | 206/459 |
| 4,750,669 | 6/1988 | Leight | 229/125.02 |
| 4,884,718 | 12/1989 | Leahy | 220/339 |
| 4,997,153 | 3/1991 | Feibelman | 248/214 |
| 5,154,293 | 10/1992 | Gould | 206/461 |

FOREIGN PATENT DOCUMENTS

| | | | |
|---|---|---|---|
| 131861 | 5/1973 | United Kingdom | 206/470 |

*Primary Examiner*—William I. Price
*Attorney, Agent, or Firm*—Leydig, Voit & Mayer

[57] ABSTRACT

A thermoformed thermoplastic blister has a forwardly extending bubble which defines a container cavity. A flange extends sidewardly from the bubble and a skirt extends rearwardly from the flange. The skirt is thermoformed with a number of undercut detents which extend inwardly and are spaced approximately the thickness of a paperboard card from the flange. A card is positioned adjacent the blister flange beneath the bubble and within the skirt. The lower portion of the card is affixed such as by heat sealing to the blister flange. The card is formed with a laterally extending fold line or weakened area which divides the card and permits the upper portion of the card to be pivoted rearwardly to alternatively cover and expose the container cavity of the blister. The detents retain the pivoted portion of the card within the skirt. The plastic blister is deformable to allow portions of the card to be pivoted rearwardly past the detents and enable recloseable uncovering of the container cavity.

9 Claims, 3 Drawing Sheets

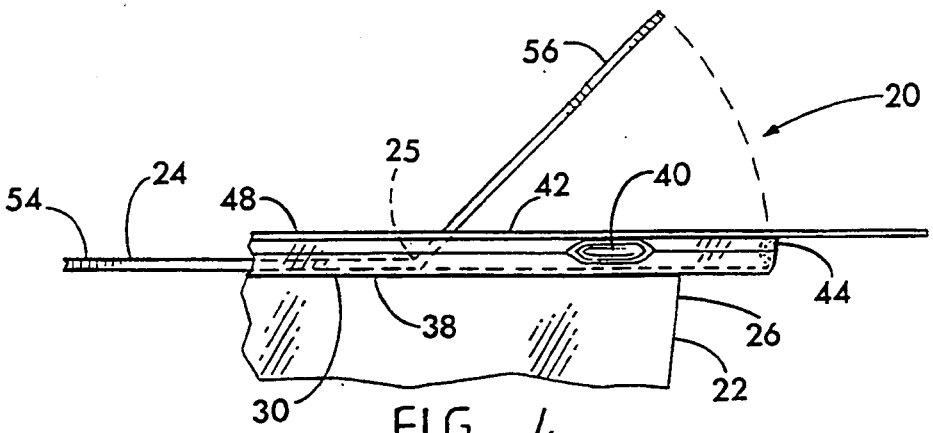
FIG. 4
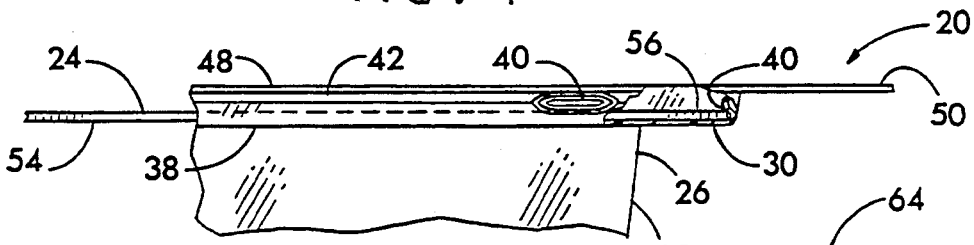
FIG. 5
FIG. 6
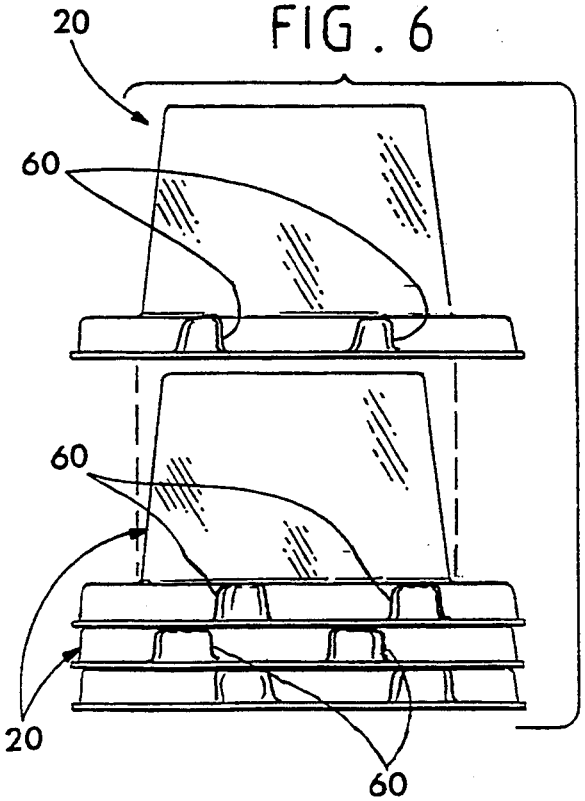
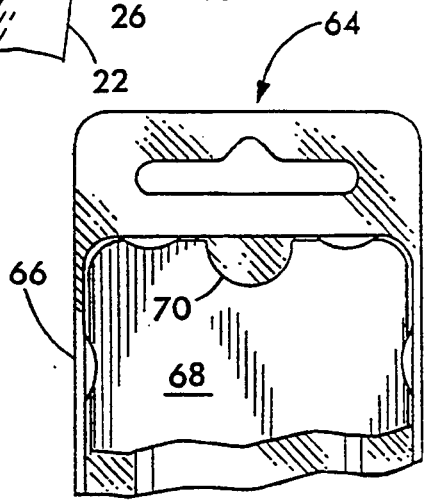
FIG. 7
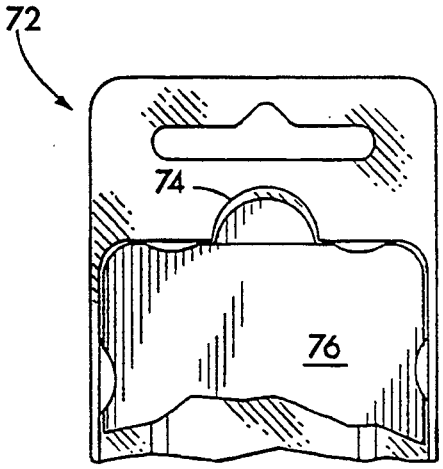
FIG. 8

BLISTER PACKAGE WITH RECLOSABLE CARD

FIELD OF THE INVENTION

The present invention relates generally to packages employing thermoformed plastic blisters and, more particularly, to recloseable blister packages.

BACKGROUND OF THE INVENTION

Display packages are commonly used in retail sales environments where it is desired to present merchandise for visual inspection by the customer. Blister packages feature a transparent bubble, typically produced through a thermoforming process, which is sealed to a backing card. One conventional method of attachment is to place a heat-activated adhesive on the card and apply heat to the card to adhere the flanges of the thermoformed bubble to the card. Display packages with blisters adhered to paperboard backing cards are effective in showcasing the merchandise. However, certain products, such as fasteners and other small items of hardware, are intended to be used only over a period of time. For such products, it is desirable to provide a package which serves as a storage container after purchase as well as a retail package. Thermoformed plastic packages having integralhinged covers with positive snap locking are known. These packages provide an attractive and functional container, but can require high initial tooling costs and material costs not always justified by the product to be carried in the package. Furthermore, blister card packages are known which utilize cut-outs or tabs on the backing card to engage with elements of the plastic blister in a recloseable manner. These packages are deficient in that they provide an opportunity for articles to protrude, or possibly to escape from the package between the card and the blister.

What is needed is an economical display package which may be displayed for retail sale, and after sale may be repeatedly and effectively closed and opened to serve as a storage container, which utilizes minimal materials.

SUMMARY OF THE INVENTION

It is an object of the present invention to provide a recloseable display package which may be economically manufactured.

It is another object of the present invention to provide a display package with a recloseable locking cover.

In large, the foregoing objects are achieved by providing a recloseable package having a thermoformed thermoplastic blister with a forwardly extending bubble which defines a container cavity. A flange extends sidewardly from the bubble and a skirt extends rearwardly from the flange. The skirt is thermoformed with a number of undercut detents which extend inwardly and are spaced from the flange by a distance approximately equal to the thickness of a paperboard card. A card is positioned adjacent the blister flange behind the bubble and within the skirt. A lower portion of the card is affixed such as by heat sealing to the blister flange. The card is formed with a fold line or weakened area which divides the card and permits the upper portion of the card to be pivoted rearwardly to alternatively cover and expose the container cavity of the blister. The detents releasably retain the unaffixed upper portion of the card within the skirt. The plastic blister is deformable to allow the upper portion of the card to be pivoted rearwardly past the detents and permit recloseable uncovering of the container cavity. The card-upper portion has a cut-away finger hole to permit a finger tip or nail to be inserted beneath the card to open the package. Alternatively, a cut-away hole may be provided exclusively in the blister or in both the blister and the card.

It is a further object of the present invention to provide a recloseable display package with a pivotable cover which may be conveniently printed upon.

These and other objects and advantages of the invention will become more apparent from the following detailed description when taken in conjunction with the accompanying drawings.

BRIEF DESCRIPTION OF THE DRAWINGS

FIG. 4 is a fragmentary side elevational view of the package of FIG. 1 with a portion of the backing card shown in a rearwardly pivoted, open position.

FIG. 5 is a fragmentary side elevational view of the package of FIG. 4, with the backing card shown in a closed position.

FIG. 6 is an exploded bottom elevational view of a stack of blisters of this invention.

FIG. 7 is a fragmentary rear plan view of an alternative package of this invention having a cut-away backing card.

FIG. 8 is a fragmentary rear plan view of an alternative package of this invention having a backing card with no cut-away.

Figure 1:
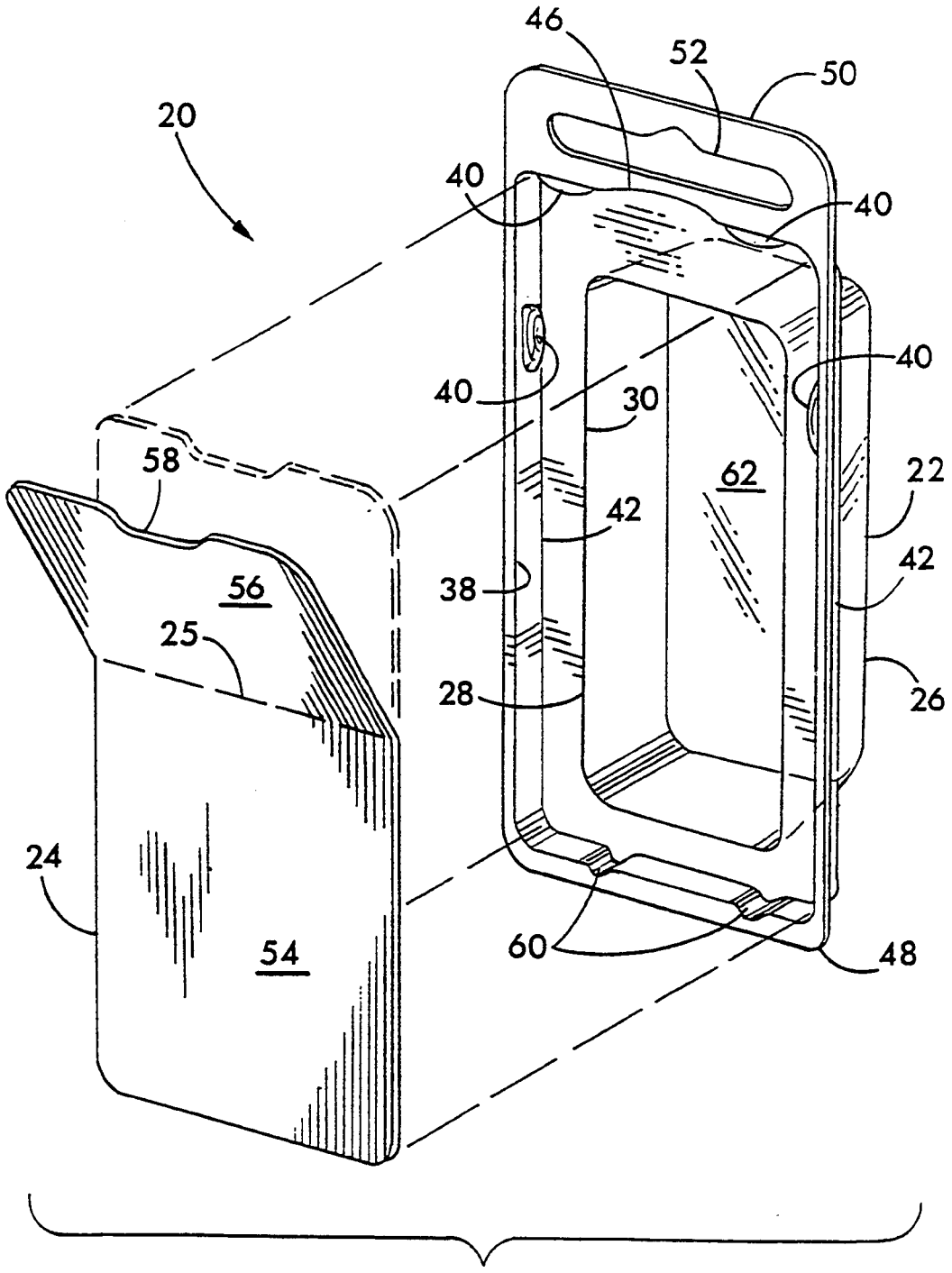
FIG. 1 is an exploded isometric view of the package of this invention.
Figure 2:
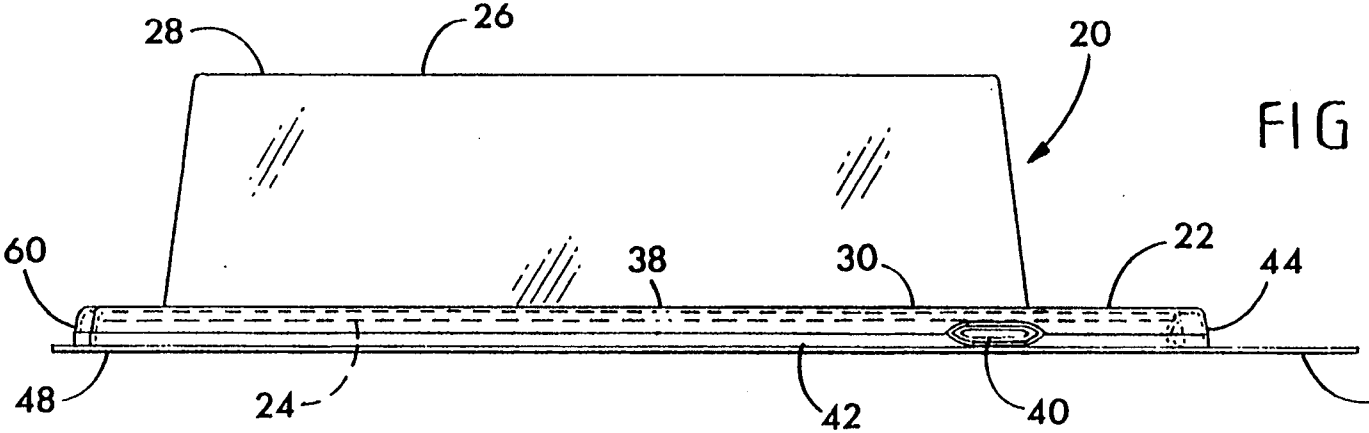
FIG. 2 is a side elevational view of the package of FIG. 1.

While the invention is susceptible of various modifications and alternative constructions, certain illustrated embodiments hereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring more particularly to FIGS. 1–8, wherein like numbers refer to similar parts, a blister package 20 is shown in FIG. 1. The package 20 is assembled from a thermoformed thermoplastic blister 22 and a paperboard backing card 24. The blister 22 is preferably formed of Recycled Polyethylene Terephthalate (RPET), but may also be formed of PET, PETG, PVC or other suitable thermoformable plastic. The blister may be thermoformed from sheet stock of desired thickness, depending on the strength requirements of the package, for example, from a sheet which is 0.015 inches thick. The card 24 may be formed of any stiff single or multi-ply paper or other suitable foldable material and may be printed on one or both sides. The card 24 is divided by a laterally extending fold line 25, which is preferably formed as a scored line in the card in the process of die-cutting the card to the desired dimensions from card stock. Herein, the fold line is located somewhat above the center of the card.

The blister 22 has a forwardly extending bubble 26 which defines, with the backing card 24, a container cavity 28 which contains the articles (not shown) to be displayed within the package 20. The bubble 26 extends forwardly from a peripheral front flange 30. The flange 30 extends sidewardly from the bubble 26 and is attached to the adjacent backing card 24 at a plurality of locations by heat-sealed regions 32. The card 24 is preferably manufactured in a process which prints the desired graphics, and which also coats the margins of the front side of the card with a heat-activated adhesive. Exposure of this coating to heat causes the adhesive to bond. During the heat sealing process, the card is positioned against the flange 30, and heat is applied from the card side. Typically, the blister will be positioned within a heat sealing fixture, and a heated platen is pressed against the card to heat selected regions of the heat-sealing adhesive to achieve a bond between the blister and the card in desired regions only. The sealed portions are indicated by the patterned areas 32 in FIG. 3. The activated adhesive is located in two regions, first in a region disposed around the periphery of the card 24 below the level of the fold line 25 at a lower adhesive region 34. The lower adhesive region 34 connects the card 24 to the blister throughout the life of the package. Second, tacking regions 36 are positioned above the fold line 25 and serve to retain the backing card in its fully closed position, as shown in FIG. 5, prior to initial opening. Herein, two tacking regions 36 are spaced around the upper periphery of the card and are separated by unadhered regions so as to permit the low-effort release of the card from the blister flange 30 at the tacking regions.

A skirt 38 extends rearwardly from the blister front flange 30 and is generally perpendicular to the flange 30. The skirt 38 surrounds the card 24 and positions it to fully obstruct the rear opening of the bubble 26. The skirt extends rearwardly from and surrounds the edges of the card 24 to prevent the escape of articles from between the blister 22 and the card 24. A plurality of undercut detents 40 is thermoformed in the blister skirt 38 and extend inwardly from the skirt. As best shown in FIGS. 4 and 5, the detents are generally elliptical protrusions which are spaced rearwardly of the blister front flange 30 and are located in the upper region of the blister to be positioned above the fold line 25 of the attached backing card 24. A detent 40 is positioned on each side wall 42 of the skirt 38. Two additional detents 40 are positioned on the top wall 44 of the skirt, one on each side of a rearwardly opening finger depression 46 formed in the skirt.

Figure 3:
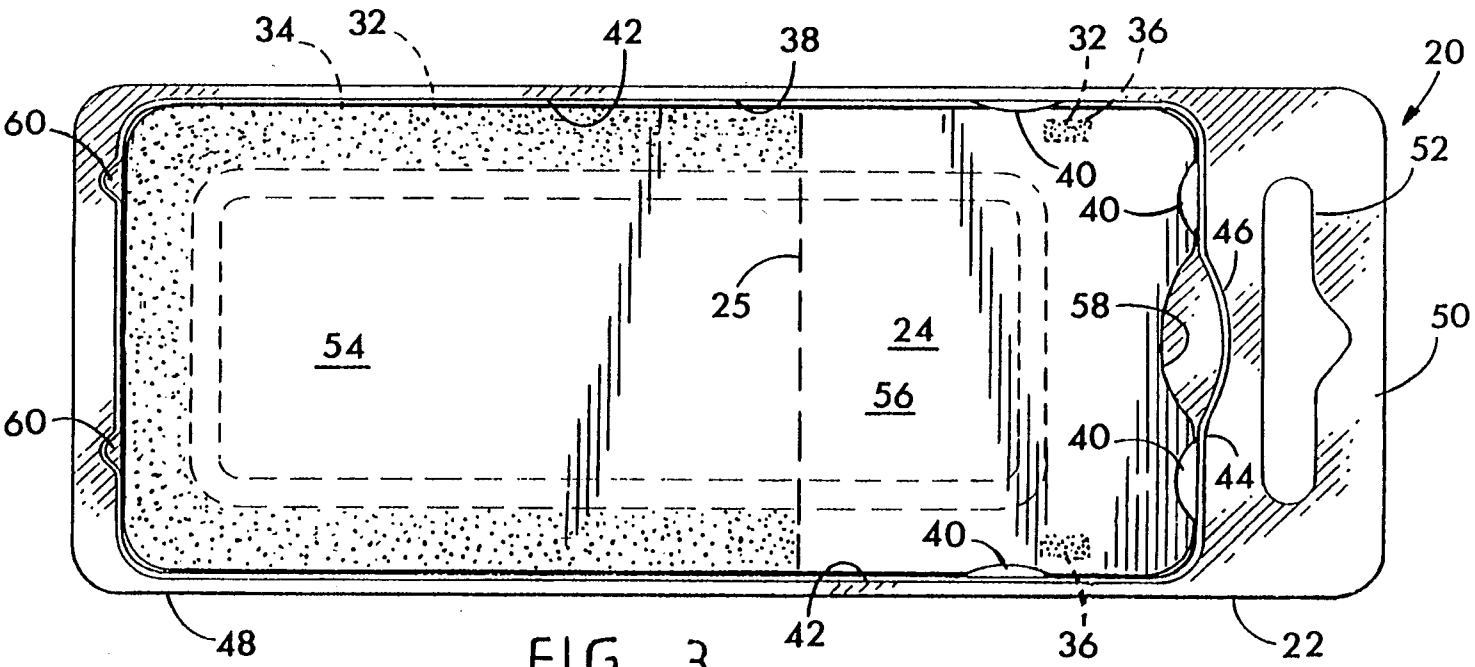
FIG. 3 is a rear plan view of the package of FIG. 1.

A rear flange 48 extends sidewardly from the periphery of the skirt 38. The package is adapted for display on a retail hook or loop by an opening at the top of the package 20, which is defined by portions of the rear flange 48 which extend upwardly to form a hang tab 50 with portions defining a butterfly-type hook-receiving opening 52, as shown in FIG. 3. Alternatively, the hook-receiving opening may be circular or of the delta type or any other appropriate geometry.

The backing card 24 is divided by the fold line 25 into a lower backing portion 54 which is fixed to the blister front flange 30, and a recloseable cover portion 56 which is pivotable between a position in which the cover portion 56 lies adjacent the front flange, as shown in FIG. 5, to a position in which the cover portion is pivoted rearwardly to reveal the interior of the bubble 26, as shown in FIG. 4.

When in a closed position, as shown in FIGS. 3 and 5, the cover portion 56 is held in place by the detents 40. The card 24, in a preferred embodiment, has a cut-away finger opening 58 located opposite the finger depression 46 formed in the blister 22. Together, the finger opening 58 and the finger depression 46 provide access for a user'fingernail, finger tip, or other pointed object between the front flange 30 of the blister 22 and the cover portion 56 of the card 24. A slight force applied between the card 24 and the blister 22 will serve to release the cover portion 56 where it has been tacked to the blister at the regions 36 and allow the cover portion to be freely pivoted between a closed and an open position. When the cover portion is reclosed, its edges cam past the flexible detents and then are held by the detents.

The package 20 is thus readily recloseable without the need for forming an integral plastic hinge, without the need for a plastic cover and without need of forming tabs or the like on the backing card 24. Furthermore, because the backing card 24 is heat sealed to the blister 22, articles may be inserted within the package 20 of the present invention utilizing conventional packaging equipment, such as that used to seal conventional blister card packages, with minimal modification.

To aid in storage and transport of the unfilled blisters 22, a plurality of denesting lugs 60 is preferably formed on each blister, as best shown in FIG. 6. The lugs 60 extend forwardly from the rear flange 48 and downwardly from the skirt 38. The lugs 60 of one blister are preferably offset sidewardly from the lugs of the blisters which are stacked on and beneath the blister 20. The lugs 60, together with the detents 40, serve to space apart stacked blisters 22 and facilitate automatic separation of the blisters prior to being filled with articles.

Because the blisters 22 are rigidified by the card 24, they may be advantageously formed on a protruding male thermoforming mold. When utilizing a male thermoforming mold, a thin plastic sheet of approximately the desired thickness of the front wall 62 of the blister bubble is heated and disposed over the mold. A pressure differential is applied to the heated thermoplastic sheet to conform it to the mold and to cause the sheet to be drawn downwardly to form the flanges and skirt at the rear of the blister. This drawing down of the plastic sheet stock results in a thinning of the stock. Because the blister is formed on a male mold, however, the front wall 62 retains its thickness. By using a male mold, sheet stock of lesser thickness may be used, as opposed to that which would be required in using a female mold.

The package 20 when initially sealed may be displayed in a retail environment by hanging on a display rod. The transparent plastic blister allows visual examination of the displayed article. Printed matter on the backing card may provide written information about the attributes and cost of the article. Furthermore, in certain applications, such as display of hardware items, a customer may remove the article from the package for comparison to a mating part or for taking measurements, and then may replace the part in the package if the article is not the one desired. More commonly, a number of small articles will be purchased in a single container. For example, a dozen screws may be contained in a single blister. The purchaser may use a single screw initially, and then may store the remaining screws until a later time within the reclosed container 20. The package finger opening permits the package to be opened without resorting to tools.

An alternative package 64 is shown in FIG. 7. Otherwise identical to the package 20, the package 64 has a blister 66 with no finger depression, but instead has a backing card 68 with a single, larger, finger opening 70.

Another alternative package 72 is shown in FIG. 8. Also otherwise identical to the package 20, the package 72 has a blister with an enlarged finger depression 74, and a card 76 with no finger opening.

It should be noted that detents of a variety of shapes and number may be employed to retain the card in a closed position. Also, the shape of the blister and the card may vary, depending on the desired container cavity and the articles to be contained. Furthermore, the card may be provided with a pivotable portion in a different location, or more than one pivotable cover may be provided in a single card with a corresponding increase in detents to retain the pivotable covers.

We claim:

1. A recloseable package comprising:

a) a thermoformed thermoplastic blister having a forwardly extending bubble which defines a container cavity;

b) portions of the blister extending sidewardly from the bubble to define a flange having a rearwardly extending skirt;

c) a card positioned adjacent the blister flange rearwardly of the bubble and within the skirt, wherein one portion of the card is affixed to the blister flange while another portion of the card is pivotable with respect to the affixed portion; and d) detents formed integrally with and extending inwardly from the blister skirt rearwardly of the card, wherein the detents retain the pivotable portion of the card within the skirt, and wherein the blister is deformable to allow the pivotable portion of the card to be pivoted past the detents and enable recloseable uncovering of the container cavity.

2. The package of claim 1 having a finger opening in the card to permit access to the front of the card for selected pivoting of the pivotable portion of the card.

3. The package of claim 1 in which a depression is formed in said blister adjacent the card to provide a finger opening to permit access to the front of the card for selected pivoting of the pivotable portion of the card.

4. The package of claim 1 in which the pivotable portion of the card includes spaced regions which are adhesively connected to the blister flange to form a detachable seal.

5. A recloseable package comprising:

a) a backing card having a pivotable portion which is adjacent to a backing portion along a score line, wherein the pivotable portion is pivotable about the score line;

b) a thermoformed thermoplastic blister having a forwardly extending bubble which defines a container cavity and having a flange which extends sidewardly from the bubble and is sealed to the backing portion of the card, wherein a skirt extends rearwardly from the flange; and c) portions of the blister defining a plurality of detents which extend inwardly from the blister skirt rearwardly of the card, wherein the detents retain the pivotable portion of the card within the skirt, and wherein the blister is deformable to allow the card pivotable portion to be pivoted rearwardly past the detents and enable recloseable uncovering of the container cavity.

6. The package of claim 5 having a finger opening in the card to permit access to the front of the card for selected pivoting of the pivotable portion of the card.

7. The package of claim 5 in which a depression is formed in said blister adjacent the card to provide a finger opening to permit access to the front of the card for selected pivoting of the pivotable portion of the card.

8. The package of claim 1 in which the pivotable portion of the card includes spaced regions which are adhesively connected to the blister flange to form a detachable seal.

9. A recloseable package comprising:

a) a backing card;

b) a thermoformed thermoplastic blister having a forwardly extending bubble which defines a container cavity and having a flange which extends sidewardly from the bubble and is sealed to the card, wherein a peripheral skirt extends rearwardly from the flange and surrounds the card to prevent escape of articles between the card and the blister; and c) portions of the blister defining a plurality of detents which extend inwardly from the blister skirt rearwardly of the card, wherein the detents retain a portion of the card within the skirt.

* * * * *